United States Patent [19]

Maiocchi

[11] Patent Number: 4,499,848

[45] Date of Patent: Feb. 19, 1985

[54] COATING APPARATUS FOR BODIES OF ELECTRICAL COMPONENTS HAVING AXIAL LEADS

[75] Inventor: John Maiocchi, Pelham, N.H.

[73] Assignee: GTE Communications Products Corporation, Stamford, Conn.

[21] Appl. No.: 562,935

[22] Filed: Dec. 19, 1983

[51] Int. Cl.[3] ..... B05C 1/02; B05C 3/09; B05C 9/04

[52] U.S. Cl. ..... 118/45; 118/206; 118/235; 118/267; 118/401; 118/217

[58] Field of Search ..... 118/401, 206, 217, 235, 118/266, 267, 226, 45, 109, 212

[56] References Cited

U.S. PATENT DOCUMENTS

| | | | |
|---|---|---|---|
| 262,022 | 8/1882 | Du Brul | 118/217 |
| 840,822 | 1/1907 | Calkins | 118/421 X |
| 2,052,621 | 9/1936 | Gurwick | 118/45 X |
| 2,155,011 | 4/1939 | Green | 118/421 X |
| 3,735,732 | 5/1973 | Van der Schoot | 118/230 |
| 3,837,471 | 9/1974 | Van der Schoot | 198/210 |
| 4,104,985 | 8/1978 | Klein | 118/226 X |

*Primary Examiner*—John P. McIntosh
*Attorney, Agent, or Firm*—Fred Fisher

[57] ABSTRACT

Apparatus for applying film coatings of material to electrical component bodies having axial leads includes adhesive tape for supporting the components in spaced relationship. A supply reel carries a supported plurality of such components. A shaft has a circumferential row of transversely oriented pockets for receiving component bodies whereby their leads are parallel. The shaft is oriented with respect to a lower reservoir providing liquid polyurethane, so that, as it rotates, sequential pockets pass through the liquid material, retaining menisci thereof therewithin. As the component bodies are received by the menisci retained pockets, underside portions of the components are coated with liquid material. A brush applies liquid material from a upper reservoir to upper portions of the carried bodies. The brush smooths the upper portions to avoid formation of globs or blobs thereon. A pair of thick tapes, provided by reels, are coupled to the axial leads whose associated bodies have been coated and applied with liquid material. A take up reel carries the supported electrical components whose bodies have been coated together with a pair of thick tapes. A motor drives a take up reel. The tapes are of sufficient thickness that components on each wrap on the take up reel are physically separated from each other. The material can be polyurethane. The pockets can be hemispherical or hemicylindrical in shape. Adhesive tape can consist essentially of polypropylene.

11 Claims, 6 Drawing Figures

COATING APPARATUS FOR BODIES OF ELECTRICAL COMPONENTS HAVING AXIAL LEADS

BACKGROUND OF THE INVENTION

1. Field of the Invention

This invention relates to apparatus for applying film coatings of material to bodies of electrical components having axial leads. Accordingly, it is a general object of this invention to provide new and improved apparatus of such character.

2. Description of the Prior Art

Certain governmental agencies have contractual relations with their suppliers that require that printed circuit boards with soldered components be cleaned with an aqueous solution. A purpose of such requirement is that the boards be flux free. Disadvantageously, the aqueous cleaning solution tends to remove identifying markings on components which are produced with poor quality ink. As some governmental agencies prefer markings on devices to be permanent, the component bodies (but not the leads) are coated with a polyurethane film to prevent loss of identification markings when cleaned.

A prior method of coating devices was to tape a length of components together, manually paint one side of the bodies of the components with liquid polyurethane, turn over the entire length of taped components, manually paint the other side of the bodies of the components with liquid polyurethane, drape the entire painted tape of components across benches, and permit the components to cure for approximately twelve hours. The taped components were required to be hung in a manner which would not allow components to touch each other or any other objects while curing.

Disadvantageously, such prior method of coating devices was slow, tedious and costly, required a large area of space for the curing step, and resulted in uneven distribution of polyurethane coatings upon the bodies of the components.

3. Information Disclosure Statement

As a means of complying with the duty of disclosure set forth in 37 CFR 1.56, the following listing of patents, publications or other information is provided which might be material to the examination of the application. Although a concise explanation of the relevance of each listed item is that such listing resulted from the completion of a preliminary novelty search, this statement shall not be construed as a representation that a search has been made or that no other material information as defined in 37 CFR 1.56(a) exists.

| U.S. Pat. No. | Patentee(s) | Patent Dates |
|---|---|---|
| 262,022 | DuBrul | Aug. 1, 1882 |
| 1,547,257 | Nasmith | July 28, 1925 |
| 2,233,865 | Graham | Mar. 4, 1941 |
| 2,271,999 | Gariepy | Feb. 3, 1942 |
| 2,918,028 | Wright | Dec. 22, 1959 |
| 4,104,985. | Klein | Aug. 8, 1978 |
| 4,141,313 | Hefele | Feb. 27, 1979 |
| 4,207,832 | Bowman et al. | Jun. 17, 1980 |

SUMMARY OF THE INVENTION

Another object of this invention is to provide a new and improved apparatus for coating taped axial lead components with a polyurethane film to prevent loss of identification marking.

Still another object of this invention is to provide a new and improved apparatus for storing coated taped axial lead components during a curing stage that is not unduly space consuming.

In accordance with one aspect of the invention, apparatus for applying film coatings of material to bodies of electrical components having axial leads includes a reservoir for supporting such material in a liquid state. A shaft, adapted to rotate about its principal axis, has a circumferential row of transversely oriented pockets for receiving the bodies of electrical components whereby their axial leads are oriented parallel to the principal axis of the shaft. The shaft is oriented with respect to the reservoir so that, as the shaft rotates about its principal axis, sequential ones of the pockets pass through the liquid state material, retaining menisci of the liquid state material therein. As the bodies of the components are received by the menisci retained pockets on the shaft, underside portions thereof are coated with the liquid material. A brush is adapted to apply the liquid state material to upper portions of the received bodies, whereby the received bodies have liquid state material applied over their entire external portions. The brush acts to smooth the upper portions of the components to avoid the formation of globs or blobs of liquid state material. In accordance with certain features of the invention, the material is polyurethane. The pockets can be hemispherical or hemicylindrical in shape.

In accordance with another aspect of the invention, apparatus for applying film coatings of material to bodies of electrical components having axial leads includes means coupled to ends of the leads for supporting a plurality of the electrical components in spaced relationship. A supply reel carries a supported plurality of the electrical components. Two reservoirs are provided for supporting such material in a liquid state. A shaft, adapted to rotate about its principal axis, has a circumferential row of transversely oriented pockets for receiving bodies of electrical components whereby their axial leads are oriented parallel to the principal axis of the shaft. The shaft is oriented with respect to one reservoir so that, as it rotates about its principal axis, sequential ones of the pockets pass through the liquid state material, retaining menisci of the liquid state material therein. As the bodies of the electrical components are received by the menisci retained pockets on the shaft, underside portions thereof are coated with the liquid material. A brush, coupled to receive liquid state material from the second reservoir, applies liquid material to upper portions of bodies carried by the shaft. The brush smooths the upper portions to avoid formation of globs or blobs on the bodies. In accordance with certain features of the invention, the material is polyurethane. The apparatus can include a pair of thick tapes for coupling the axial leads of the components whose bodies have been coated and applied with liquid material, a take up reel for carrying a plurality of supported electrical components whose bodies have been liquid coated and liquid applied, together with the pair of thick tapes, and means for driving the take up reel. The tapes are of sufficient thickness that components on each wrap on the take up reel are physically separated from components on successive wraps on the take up reel. The material can be polyurethane. The pockets can be hemispherical or hemicylindrical in shape. The tapes can consist essentially of polypropylene. A storage reel can be provided for carrying the pair of thick tapes for transport to the take up reel.

BRIEF DESCRIPTION OF THE DRAWING

Other objects, advantages, and features of this invention, together with its construction and mode of operation, will become more apparent from the following description, when read in conjunction with the accompanying drawing, in which.

DESCRIPTION OF PREFERRED EMBODIMENT(S)

Figure 1:
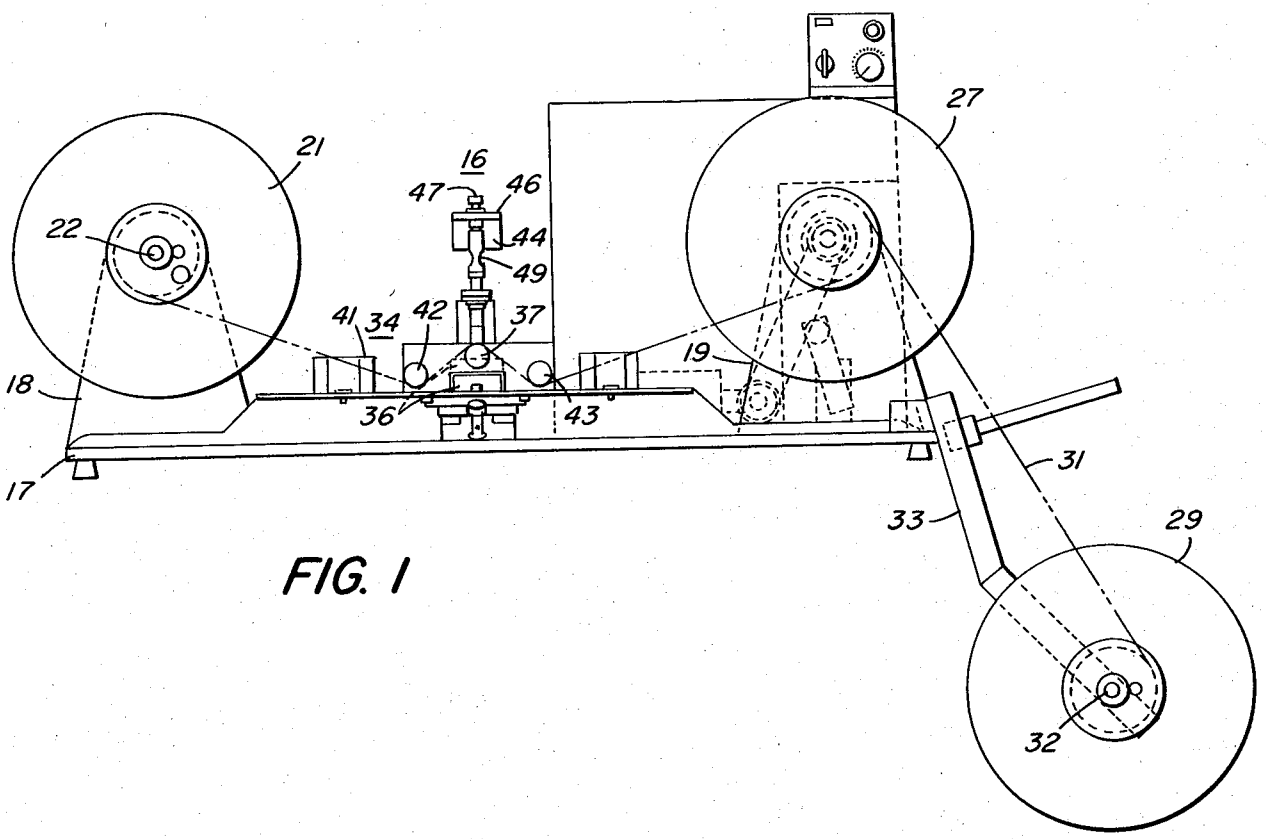
FIG. 1 is an elevational view of coating apparatus in accordance with one embodiment of this invention.

Referring to the drawing, there is shown a plurality of electrical components 11—11 having axial leads 12—12. Each component 11 includes a body 13. The bodies 13—13 can be of various shapes such as cylindrical or spherical. The components 11—11 may be best viewed in FIGS. 2, 3 and 4.

Figure 2:
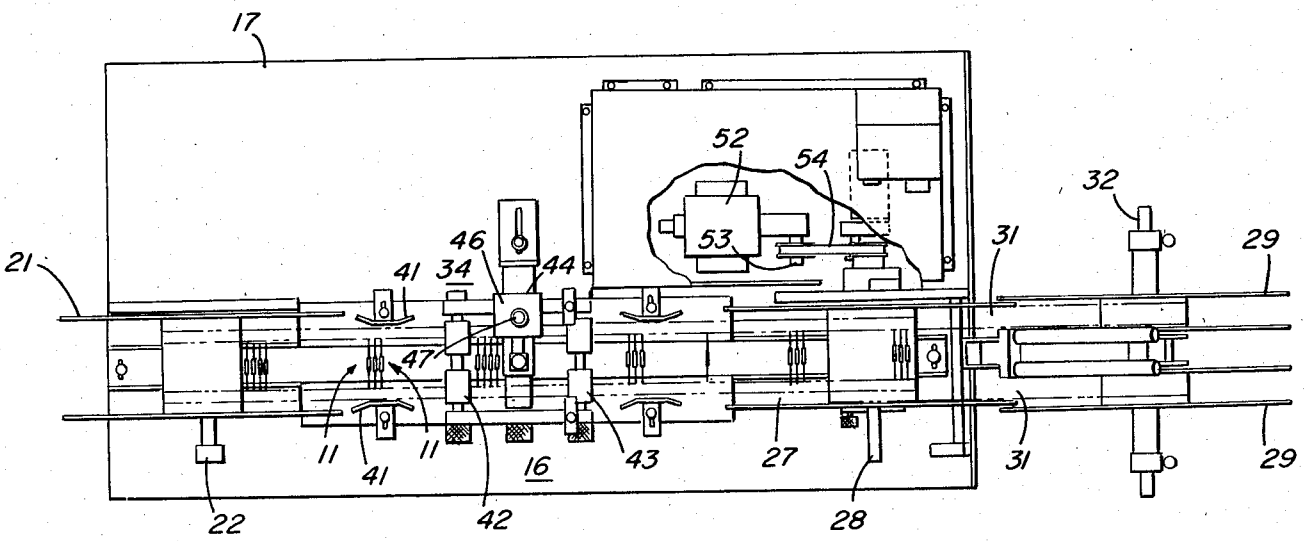
FIG. 2 is a top view, partly broken away, of the embodiment depicted in FIG. 1.
Figure 3:
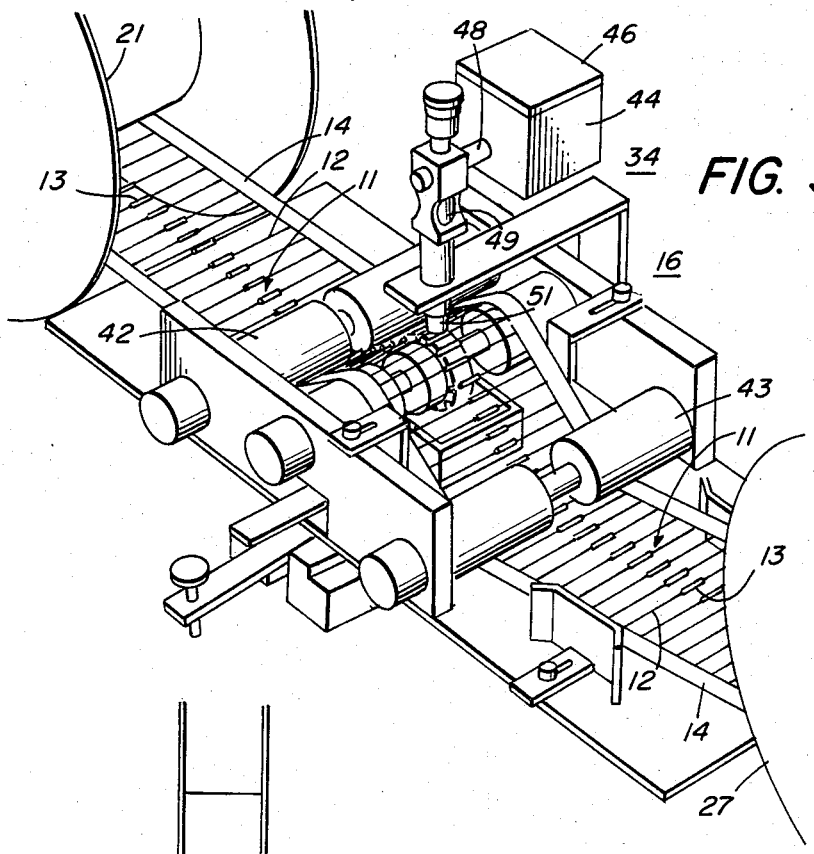
FIG. 3 is a perspective view of a portion of the embodiment depicted in FIGS. 1 and 2.
Figure 4:
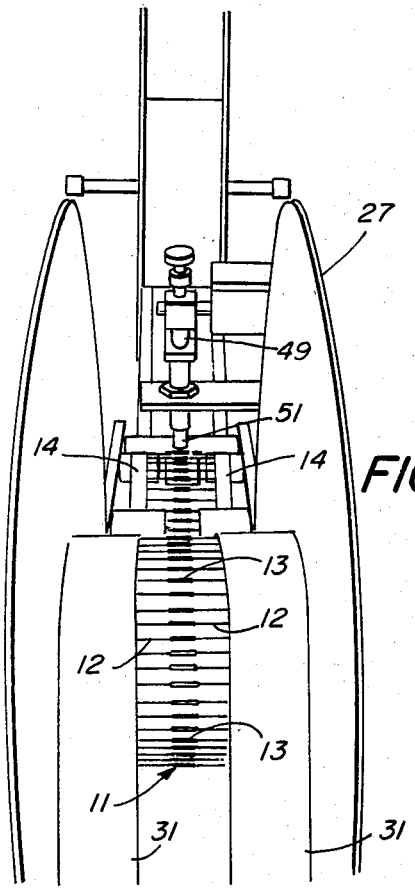
FIG. 4 is an end view of a partially filled take up reel utilized in the embodiment of FIGS. 1 and 2.

As viewed in FIGS. 2 and 3, the ends of the axial leads 12—12 of the various electrical components 11—11 are supported in spaced relationship by suitable means, such as a pair of parallelly arranged adhesive coated tapes of material such as ¼" wide by 1/64" thick fabric or plastic tape 14—14.

Coating apparatus 16 for applying film coatings of material to the bodies 13—13 of electrical components 11—11 is depicted in the drawings. Referring more particularly to FIG. 1, there is depicted a base plate 17 to which is affixed (at the left, as viewed) a reel support 18. In similar fashion, at the right, as viewed in FIG. 1, a reel support 19 is affixed to the base plate 17.

As viewed in FIGS. 1 and 2, a supply reel 21 for feeding out a plurality of taped components 11—11 is supported on a suitable shaft 22, which is carried by the reel support 18. The shaft 22 can have associated therewith a suitable compression spring 23 and associated tension arm base 24 in accordance with one mode of the invention. The spool 21 can be provided with a spool adapter 26 in accordance with a mode of practicing the invention.

A take up reel 27 (shown at the right side of FIGS. 1 and 2) has a shaft 28 associated therewith that is supported by the reel support 19. Various components, non-essential to an understanding of this invention, can be associated with the shaft, such as a locking collar and an extension spring.

Spools of ¼"×1" polypropylene strips 31—31 are carried by a pair of reels 29—29. The reels 29—29 are supported on a reel shaft 32, the shaft 32 being held by a bracket 33 that is affixed to the base plate 17. The shaft 32 can have various hardware associated therewith, such as a locking knob and a spacer.

Between the supply reel 21 (which supports a reel of taped components which have not been treated) and the take up reel 27, there is provided a treatment station 34 including a lower reservoir 36 which holds a quantity of liquid polyurethane. Immediately above the lower reservoir 36 is a carrier shaft or sprocket 37.

Figure 6:
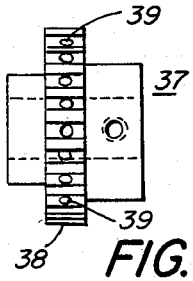
FIGS. 5 and 6 are top and elevational views, respectively, of a carrier sprocket utilized in the embodiment of FIGS. 1 and 2.
Figure 5:
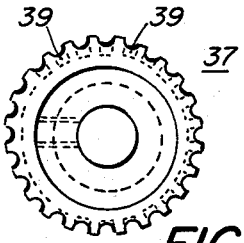

The carrier sprocket 37 is adapted to rotate about its principal axis between the parallelly arranged pair of tapes 14—14. As best viewed in FIGS. 5 and 6, the carrier sprocket 37 has a circumferential row 38 of transversely oriented pockets 39—39 which are adapted to receive the bodies 13—13 of the electrical components 11—11. When so received, the axial leads 12—12 of the received components 11—11 become oriented parallel to the principal axis of the carrier sprocket 37. The carrier sprocket 37 is so oriented with respect to the lower reservoir 36 that, as the shaft or carrier sprocket 37 rotates about its principal axis, sequential ones of the pockets 39 pass through the liquid state material in the lower reservoir 36. As those pockets 39—39 pass through the liquid state material, menisci of liquid state material are retained by the pockets and, as the bodies 13—13 are received by the menisci retained pockets on the carrier sprocket 37, underside portions of those bodies are coated with the liquid material.

As depicted in solid lines in FIG. 1, the lower reservoir 36 is retracted away from the sprocket 37. After liquid polyurethane has been added to the reservoir 36, the reservoir 36 may be raised to the dotted line position of FIG. 1 so that, as the sprocket 37 rotates about its principal axis, the pockets 39—39 pass through the liquid state material. As the level of liquid polyurethane changes, the reservoir 36 may be varied to compensate for such change.

To aid in the guide of the transport of the taped electrical components from the supply reel 26 to the take up reel 27, the taped spaced components pass alongside a tape guide 41 which is oriented on both sides of the spaced components to limit lateral movement, and then under a lower tape guide 42 (which is a roller) that aids in maintaining suitable tension upon the taped array of components. The roller or tape guide 42 is oriented transverse to the direction of movement of the taped components. The taped array then passes over the sprocket carrier 37 and down under another lower tape guide 43, and, thence, to the take up reel 27. The lower tape guides 42, 43 are similar and provide suitable tension to the taped array.

An upper reservoir 44 is provided for housing liquid polyurethane. The upper reservoir 44 can be provided with a suitable cover 46, a handle 47, a feeder pipe 48, and a valve 49, all feeding to a brush 51 arranged over sprocket 37 which is directed to apply liquid polyurethane to the bodies of the components as they pass thereby.

A motor 52, which can be shunt wound, has a drive sprocket 53 and associated drive belt 54 for driving the shaft 28 and, hence, the take up reel 27.

In operation, the motor 52 drives the take up reel 27 to cause the components on the supply reel 21 to unreel. The components are then transported over the carrier sprocket 37 and under the brush 51, both of which have respective reservoirs 36, 44 containing liquid polyurethane. The purpose of the brush application is two fold: The brush 51 acts to coat the uppermost side of the components 11—11 and also wipes the components 11—11, distributing the coating evenly. The taped 14—14 components 11—11 are then fed onto the take up reel 27 simultaneously with two ⅛×1" polypropylene strips from the reels 29—29. The polypropylene strips 31—31 operate to provide a space between the layers of components 11—11 at each wrap on the take up reel. The completed take up reel 27 can be suitably removed from the overall apparatus 16 so that the components be permitted to cure. Such curing can occur within an oven, not shown, in accordance with techniques well known to those in the art.

The carrier sprocket 37 has its pockets 39—39 formed to accommodate the particular shaped devices that are transported thereby. For a cylindrical device, the pockets are formed in a hemicylindrical fashion. Similarly, for a spherical fashion, the pockets are formed in a hemispherical form. Thus, as properly formed, the pockets, as they pass through the liquid polyurethane in the lower reservoir 36, retain menisci of liquid polyurethane therewithin and, as the bodies of the components are transported by the carrier sprocket 37, the lowermost portions of the devices are coated with the liquid polyurethane.

The uppermost portions of the devices have liquid polyurethane applied by the top reservoir 44 via the brush 51, the brush 51 smoothing the top surfaces of the devices so that no globs or blobs are formed on the various bodies 13—13 of the electrical components 11—11.

Although as indicated above, the take up reel, when full, is inserted into a furnace for curing, it is noted, of course, that curing can also occur by ordinary air drying. Furnace drying effectuates the curing process at a quicker rate and, for that reason, polypropylene is a desirable material for tape as it conveniently withstands the high temperature of a furnace.

Apparatus constructed in accordance with teachings of this invention operates faster than the manual operation of the prior art. For example, constructed apparatus is capable of coating devices at a rate in excess of 5,000 components per hour. In comparison, the manual method described hereinabove was able to coat approximately 100 components per hour.

A reel can store approximately 4,000 components on a 14" during curing. In comparison, the hand or manual method (i.e., the components being draped along a bench while one side is cured and then turned over and coated on the opposite side and permitted to cure, each component being tediously coated with a small artist brush) requires a total cure time of approximately 24 hours and extensive floor space.

Various modifications can be performed with this invention without departing from the spirit and scope thereof. For example, various types and shapes of brushes can be used. The pick up sprockets can be made of different materials. The reservoirs can be made of different configurations. The coatings can be of different material.

What is claimed is:

1. Apparatus for applying film coatings of material to bodies of electrical components having axial leads, the ends of the axial leads supported in spaced relationship by a parallelly arranged pair of tapes, comprising:

a reservoir for supporting said material in a liquid state;

means for transporting said components and tape;

a sprocket adapted to rotate about its principal axis between said parallelly arranged pair of tapes, having a circumferential row of transversely oriented pockets for receiving said bodies of electrical components whereby said axial leads of received components are oriented parallel to said principal axis, said sprocket being oriented with respect to said reservoir so that, as said sprocket rotates about said principal axis, sequential ones of said pockets pass through said liquid state material, retaining menisci of said liquid state material therein, and, as said bodies are received by said menisci retained pockets on said sprocket, underside portions of said received bodies are coated with said liquid material; and brushing means arranged over said sprocket for applying said material in said liquid state to upper portions of said received bodies, whereby said received bodies have said liquid state material applied over their entire external portions, and for smoothing said upper portions to avoid the formation of globs or blobs of said liquid state material.

2. The apparatus as recited in claim 1 wherein said pockets are hemispherical in shape.

3. The apparatus as recited in claim 1 wherein said pockets are hemicylindrical in shape.

4. The apparatus as recited in claim 1 which further includes a first and second tape guide roller arranged to provide a tape path passing below said first roller, over said sprocket and under said second roller thereby providing tension to said parallelly arranged pair of tapes.

5. Apparatus for applying film coatings of material to bodies of electrical components having axial leads the ends of the axial leads supported in spaced relationship by a parallelly arranged pair of tapes, comprising:

a means for transporting said components and tape coupled to ends of said axial leads for supporting a plurality of said electrical components in spaced relationship;

a supply reel for carrying a supported plurality of said electrical components;

a first reservoir for supporting said material in a liquid state;

a sprocket adapted to rotate about its principal axis between said parallelly arranged pair of tapes, having a circumferential row of transversely oriented pockets for receiving said bodies of electrical components whereby said axial leads of received components are oriented parallel to said principal axis, said sprocket being oriented with respect to said reservoir so that, as said sprocket rotates about said principal axis, sequential ones of said pockets pass through said liquid state material, retaining menisci of said liquid state material therein, and, as said bodies are received by said menisci retained pockets on said shaft, underside portions of said received bodies are coated with said liquid material;

a second reservoir for supporting said material in a liquid state; and a brush, arranged to receive liquid state material from said second reservoir, and arranged over said sprocket for applying liquid material to upper portions of bodies carried by said sprocket and for smoothing said upper portions to avoid formation of globs or blobs thereon.

6. The apparatus as recited in claim 5 further comprising:

means for providing a pair of thick strips for coupling to said axial leads of said components whose bodies have been coated and applied with said liquid material; and wherein said means for transporting said components and tape is a take up reel for carrying a plurality of supported electrical components whose bodies have been liquid coated and liquid applied, together with said pair of thick tapes, said strips being of sufficient thickness that components on each wrap on said take up reel are physically separated from components on successive wraps on said take up reel; and means for driving said take up reel.

7. The apparatus as recited in claim 6 wherein said pockets are hemispherical in shape.

8. The apparatus as recited in claim 6 wherein said pockets are hemicylindrical in shape.

9. The apparatus as recited in claim 6 wherein said strips consist essentially of polypropylene.

10. The apparatus as recited in claim 6 further comprising a storage reel for carrying said pair of thick strips for transport to said take up reel.

11. The apparatus as recited in claim 5 which further includes a first and second tape guide roller arranged to provide a tape path passing below said first roller, over said sprocket and under said second roller thereby providing tension to said parallelly arranged pair of tapes.

* * * * *